United States Patent [19]

McMahon et al.

[11] Patent Number: 5,027,584

[45] Date of Patent: Jul. 2, 1991

[54] METHOD AND APPARATUS FOR UNFOLDING FOLDED ZIPPER FILM

[75] Inventors: Michael J. McMahon, Palatine; Hugo Boeckmann, Arlington Heights, both of Ill.

[73] Assignee: Illinois Tool Works, Inc., Glenview, Ill.

[21] Appl. No.: 464,020

[22] Filed: Jan. 12, 1990

[51] Int. Cl.[5] ..... B65B 9/08; B65B 41/16; B31B 1/90

[52] U.S. Cl. ..... 53/451; 53/133.3; 53/389.1; 53/412; 53/551; 226/179; 493/214

[58] Field of Search ..... 53/128, 133, 389, 410, 53/412, 450, 451, 550, 551, 552, 553, 554; 493/213, 214, 390; 226/15, 175, 179, 190

[56] References Cited

U.S. PATENT DOCUMENTS

| | | | |
|---|---|---|---|
| 3,815,317 | 6/1974 | Toss | 53/551 X |
| 4,646,511 | 3/1987 | Boeckmann et al. | 493/244 X |
| 4,663,915 | 5/1987 | Van Erden et al. | 493/214 X |
| 4,691,499 | 9/1987 | Umeda et al. | 53/389 X |
| 4,704,842 | 11/1987 | Boeckmann et al. | 493/439 X |
| 4,727,709 | 3/1988 | Zieke et al. | 53/551 |
| 4,790,126 | 12/1988 | Boeckmann | 493/213 X |
| 4,829,745 | 5/1989 | Behr et al. | 53/451 |
| 4,840,012 | 6/1989 | Boeckmann | 53/552 X |
| 4,941,307 | 7/1990 | Wojcik | 53/133 X |

*Primary Examiner*—John Sipos
*Assistant Examiner*—Beth Bianca
*Attorney, Agent, or Firm*—Hill, Van Santen, Steadman & Simpson

[57] ABSTRACT

A method and a mechanism for making plastic film bags having a reclosable zipper including wrapping a continuous supply of film over a forming tube to form a seam joining the edges of the film and cross-seaming the film, supporting the supply roll of film with the film doubled and a zipper at the doubled edge; guiding the location of the zipper in the film so that the film is properly positioned as it is fed forwardly to be wrapped over the forming tube and means unfolding the film as it is fed forwardly to open the doubled film to be fed to the forming tube as a flat sheet.

14 Claims, 3 Drawing Sheets

FIG. 1
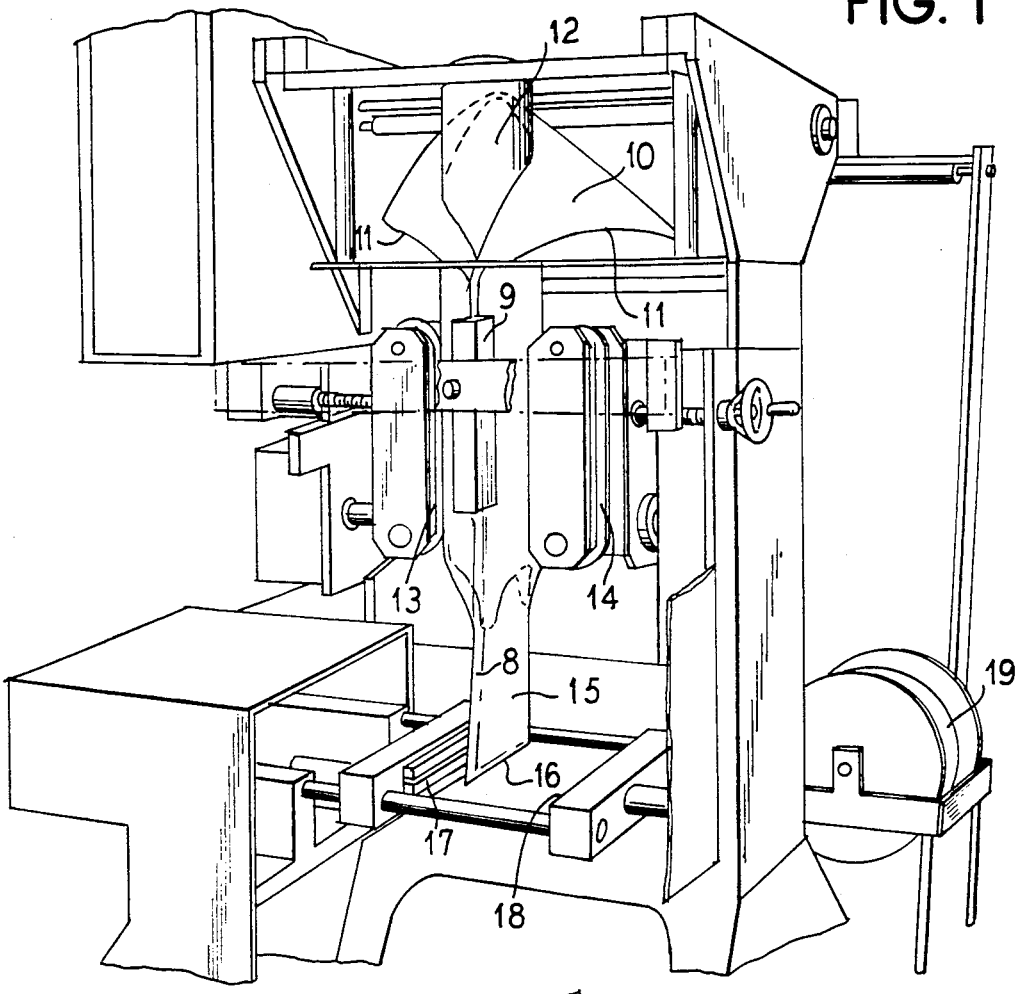
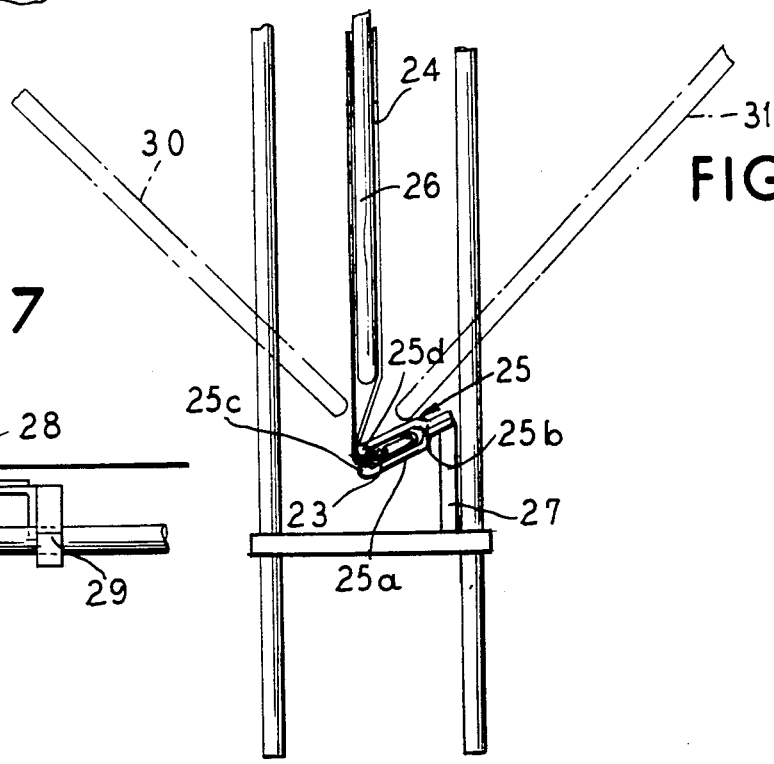
FIG. 6
FIG. 7
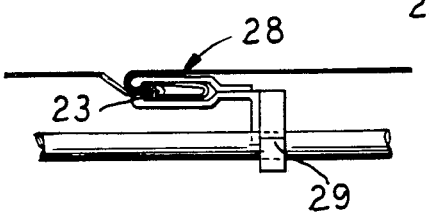

METHOD AND APPARATUS FOR UNFOLDING FOLDED ZIPPER FILM

BACKGROUND OF THE INVENTION

The present invention relates to improvements in form, fill and seal machines, and more particularly to a bag forming machine wherein an endless supply of plastic film with a zipper intermediate the edges is fed over a forming and filling tube and the edges sealed to form a tubular bag.

In a form, fill and seal operation, an endless continuous supply of film is brought forwardly and is shaped and wrapped around a filling and forming tube. The shaped film has its edges brought together and joined to form a tubular container. Contents are dropped through the filling tube into the container and cross-seals are formed to provide lengths of bags which are cut apart. In one method of forming bags in a form, fill operation, the film is provided with reclosable rib and groove zipper profiles extending longitudinally along the film parallel to the forming axis of the film. In the formation of the film into tubular form, the profiles can be joined as the bag is formed. It has been discovered that a stable operation can be accomplished by utilizing film where the profiles are already joined and are located intermediate the edges of the film. In this operation, the edges of the film are brought together to form a bottom seam for the bag. An example of a bag formation where the profiles are brought together is shown in Tilman U.S. Pat. No. 4,355,494. In U.S. Pat. Christoff and Ausnit 4,617,683, the formation of bags is illustrated where the raw edges of the film are joined, and in the present arrangement, a formation procedure such as that shown in the Christoff et al patent is employed with film being supplied where the interlocked profiles are located intermediate the edges of the film.

The packaging of products for retail sale and consumption has developed gradually over the years in order to enhance the ease with which the consumer can open the packaging in order to gain access thereto for use or consumption of the food product therein. In the form, fill and seal operation described above, such reclosable packages can be developed at relatively high manufacturing speed using an endless supply of film where the profiles are already extruded as part of the film and previously interlocked. In such packaging and package making, the containers are manufactured with the interlocking rib and groove profiles accurately and critically made so that they will protect the contents, such as foodstuffs, therein and yet be readily opened and reclosed. The profiles are made to be very relatively minute, and as such with accurate manufacturing tolerances, the shape and size of the profile must be accurately maintained and not distorted either in manufacture or in storage. It is a desirable attribute of such packaging that the bags be closed securely in an airtight manner to maintain freshness of a food product remaining within the package. The food products may be of varying types such as that which are packaged and stored within a box or carton which has the bag as an internal liner or pouch to contain dry cereal products. Other forms of packages or pouches can be made which are handled, stored and sold without a protective carton surrounding them.

The film from which the bag is made is normally made by an extrusion process. In the process, the interlocking profiles which will form the zipper for the bag are extruded and are very small, but are critically shaped and sized so that they will interlock with optimum strength. In the process of manufacture of the film, when it is extruded and cooled, it is continuously wound on a roll to be stored and shipped to the bag manufacturer. The film is normally folded double with the interlocking zipper profiles located intermediate the edges of the film and essentially at the doubled edge of the film.

The doubled film thus will be thicker at the location of the interlocked profiles to avoid the thicker part of the film from building up on the roll as it is wound, the film is led spirally back and forth across the axis of the roll so that the location of the zipper changes axially as layers of the film are built up on the storage roll. This means that as the film is unwound off the storage roll, the location of the zipper will shift axially along the roll as the layers are removed from the roll. The forming machine, however, requires that the film be in one fixed location as it is fed and wrapped over the forming and filling tube.

In order to positively locate the film relative to the required position of the film when it is wrapped on the tube, it has heretofore been necessary to provide a mechanism which continually moves the supply roll axially in an amount to positively locate the zipper at the same location as the film is unwound. This requires special equipment to carry the heavy roll of film and to continually move it a proper amount in the axial direction. This also requires that the film always be wound on the supply roll in a uniform manner so that a given mechanism which moves the roll axially will always position the zipper correctly.

FEATURES OF THE INVENTION

Accordingly, an object of the present invention is to provide a film supply method and mechanism wherein machinery for axially moving the supply roll to locate the zipper correctly axially is eliminated.

A further object of the invention is to provide a mechanism wherein film having a zipper extending therealong is fed accurately to a forming tube with the zipper always correctly located relative to the forming tube axis.

A further object of the invention is to provide means for channeling and guiding an endless length of film having a zipper extending longitudinally therealong between the film edges.

In accordance with the principles of the invention, a supply roll for a film which is to be fed to a vertical form, fill and seal machine is mounted on a simple unwinding axis with the axis of the supply roll being substantially at right angles to the plane of the film. The film is carried on the supply roll doubled with the zipper profiles at the edge and is opened to a single layer as it is unwrapped. Between the mechanism which opens the doubled folded film and the supply roll, is a guide mechanism which controls the position of the profiles and shifts the profile location relative to the axis of the roll so that it is always in a predetermined fixed position. This eliminates the need for continually moving the supply roll. It also assures that regardless of how the film is wrapped on the supply roll, that the profile and the film will always be positively and correctly located as it reaches the forming tube.

Other objects, advantages and features will become more apparent with the teaching of the principles of the invention in the disclosure of the preferred embodiment in the specification, claims and drawings, in which:

DESCRIPTION OF THE DRAWINGS

FIG. 1 is a perspective view of a forming and filling mechanism for forming tubular bags from plastic film;

FIG. 6 is a detailed sectional view taken substantially along line VI—VI of FIG. 3; and FIG. 7 is a sectional view taken substantially along line VII—VII of FIG. 3

DESCRIPTION OF THE PREFERRED EMBODIMENT

Figure 2:
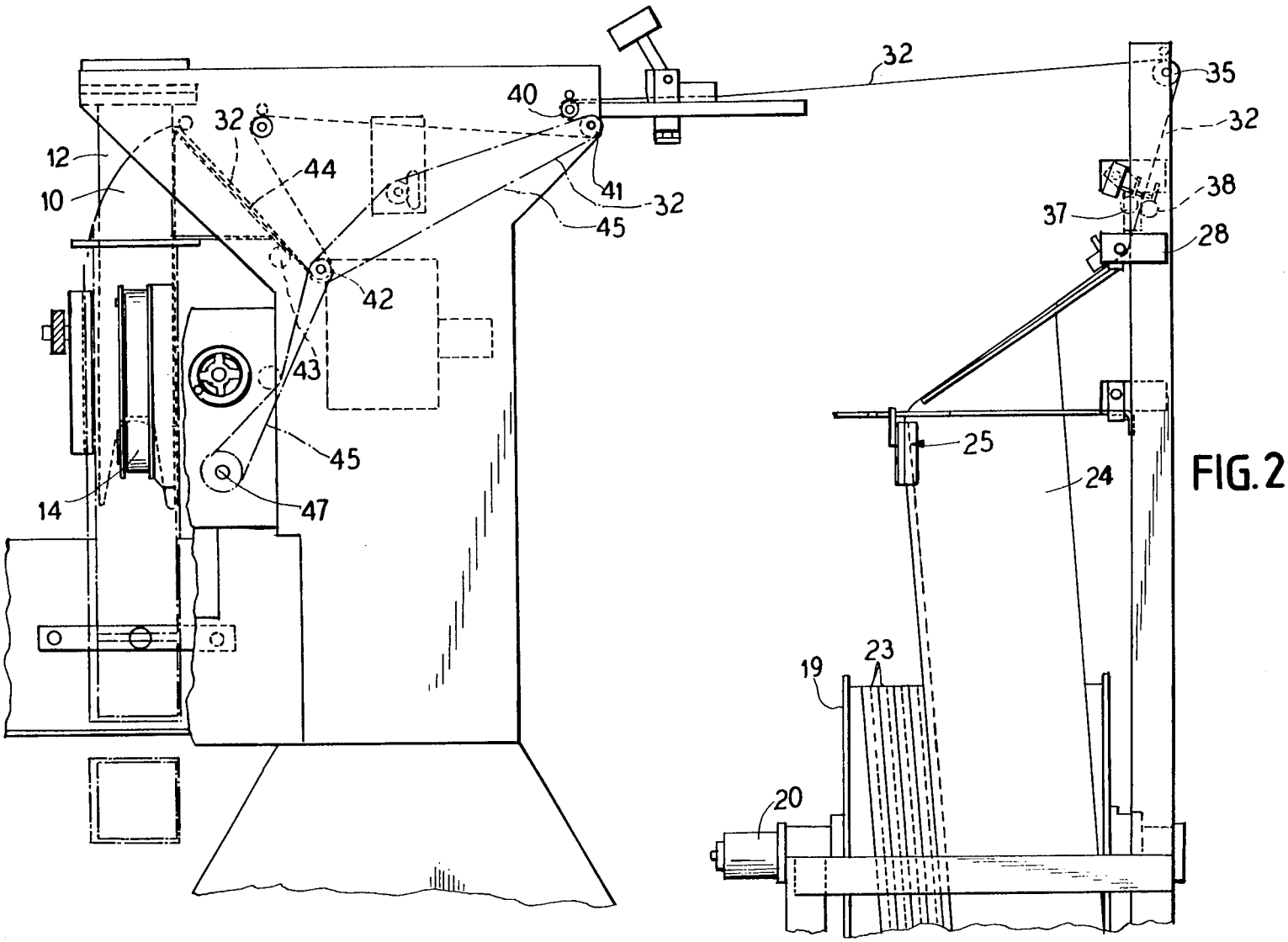
FIG. 2 is a side elevational view of the forming mechanism also illustrating the film supply mechanism.

FIG. 1 illustrates a portion of a machine for forming tubular bags or pouches. A flat sheet of thin plastic film 10 is fed onto the machine guided by shoulders 11 which cause the film to be wrapped around a vertical forming and filling tube. The tube is hollow so that when a tubular bag is formed, the bag contents are dropped downwardly through the tube 12.

The film, wrapped around the tube 12 in tubular form, is advanced by being pulled down incrementally by friction belts 13 and 14 which engage the outer surface of the tube and which are driven forward each time a bag is formed and filled.

The formed bag is shown at 15 for receiving the contents dropped through the tube 12. A cross-seal 16 is formed at the end of the bag by sealing bars 17 and 18 which are power driven to be brought against the bag and form a cross-seal. A heated seaming device 9 joins the edges of the film to form a seam at 8. Opposite the seam 8 will be interlocked rib and groove profiles. As the bag is filled, the belts 13 and 14 drive it down so that the cross-sealing devices 17 and 18 can seal the other side of the bag and cut it free of the descending tubular film.

The plastic film is fed off of a supply reel 19 which will be described in greater detail in connection with FIGS. 2 and 3.

As illustrated in FIG. 2, the supply reel 19 has plastic film folded double thereon with rib and groove interlocked profiles 23 along one edge. The reel is originally wound so that the profiles do not lie on top of one another but proceed spirally axially along the reel. The reel is supported for free-wheeling rotation on an axle 20.

In devices heretofore available, to insure that the interlocked zipper profiles would be fed at one location, the reel had to be provided with a mechanical drive which moved it axially and maintained the zipper at one location. With the present arrangement, this is not necessary and the film can be freely drawn from the reel with guide devices shown at 25 and 28 which insure that the zipper profiles will always be accurately centered in the film as it is moved forwardly onto the forming and filling tube 12.

A second reel 21, supported on an axle 22, can be kept in readiness to be immediately started when the first reel 19 is empty. This provides another advantage in that substantial delays are not encountered switching from one reel to another and a simple stand is all that is necessary to support the film supply reels.

Figure 4:
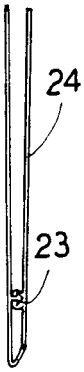
FIG. 4 is a fragmentary vertical sectional view taken substantially along line IV—IV of FIG. 3.

The film as it is folded doubly, is shown in FIG. 4 with the interlocked profiles 23 substantially at one edge of the doubled film.

It should be noted that the film does not have to be folded so that the side legs of the film extending from the zipper are equal in length. By folding the film such that the sides are unequal in length, the zipper will appear at a different location on the face of the finished bag. The seam which will eventually be formed by joining the ends of the two legs of film will normally appear at the bottom of the flattened bag. As the film is fed upwardly, it is unfolded so that it will lie flat in the manner illustrated in FIGS. 2, 3 and 5 at 32.

As the film is drawn upwardly, it passes a smooth flat dividing board 26 which is located between the folds of the film. The interlocked profiles 23 enter the first guide 25 as shown in FIG. 6. The guide 25 is adjustably mounted on a support 27 to insure that the zipper profiles are accurately positioned as the film travels upwardly. The guide has fingers 25*a* and 25*b* which lie alongside of the zipper 23 and the small loop of material above the zipper. At the ends of the fingers, are bulbous portions 25*c* and 25*d* which press beneath the zipper to insure that it remains in the slot between the fingers 25*a* and 25*b*.

Figure 5:
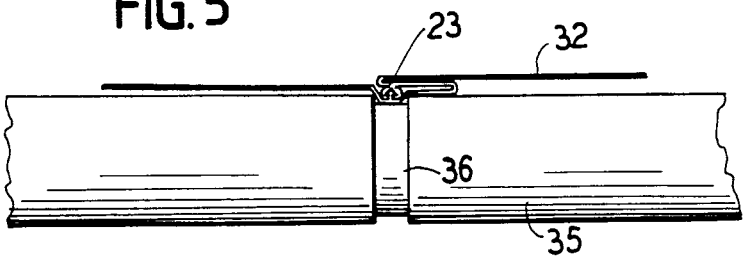
FIG. 5 is a detailed plan view partially in section of a support roller for guiding the film.

The angle at which the guide 25 is positioned is significant in that it is required that the zipper be folded back on itself when the film is being spread to prevent the zipper from popping open while the film is being unfolded. Thus, the angle of the guide, and the angle of its slot which controls the angle at which the zipper is fed forwardly, is arranged to form an acute angle relative to the plane of the film 24 and of the plate 26. This insures that the zipper will be folded back on itself at the spreader bars 30 and 31 to prevent the zipper from popping open. Layers of film which will form the side walls of the bag are thus unfolded and spread out to place the web in a single plane as it reaches the upper roller 35. The zipper remains doubled on itself as shown in FIG. 5, being turned and held double by the guide 25.

Figure 3:
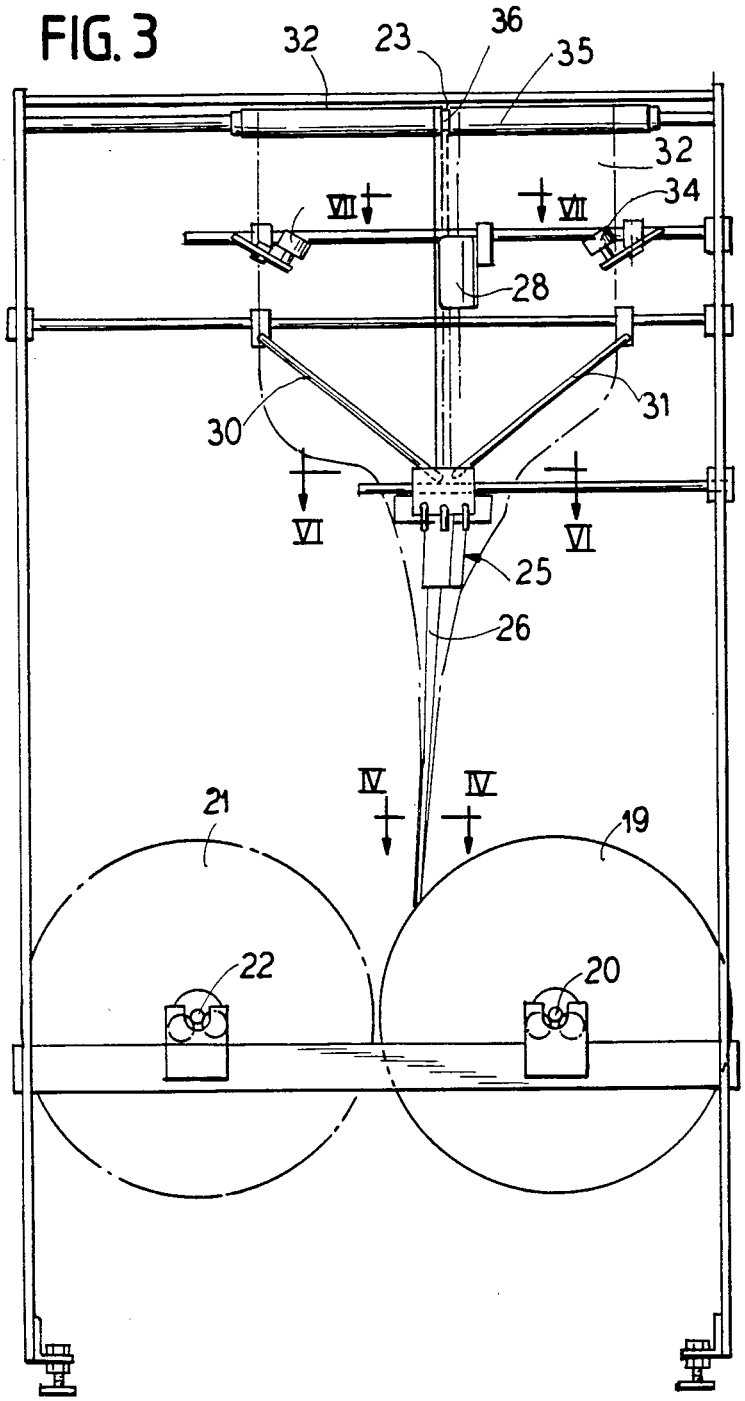
FIG. 3 is a more detailed elevational view showing the mechanism for unwinding and unfolding the film from a supply roll.

The film next is unfolded being laid open against lateral unfolding guides 30 and 31, FIG. 3. These guide the film outwardly until it is in a lay-flat position, which position it maintains in its entire travel to the forming tube 12, as is illustrated in FIG. 2.

To further insure that the zipper profiles will remain accurately centered, they are guided through a second guide 28, illustrated in FIG. 7. The guide 28 is constructed substantially identical to the guide 25 and need not be described further in detail. The guide is also mounted on an adjustable support 29 which is set so that the zipper profiles 23 will be accurately centered.

While a film is shown where the zipper is spaced substantially equally intermediate the edges, the profiles can be closer to one edge than the other, and the machine can be quickly set by changing the location of the guides 25 and 28.

As the opened film sheet ascends, it passes spreader rollers 33 and 34 which help flatten the sheet. The sheet then is turned 90° over an upper roll 35. The roll 35, as shown in FIGS. 2 and 5, is provided with a groove 36 at its center to accommodate the extra thickness of the zipper profiles 23.

The flattened sheet 32 then travels horizontally over rolls 40 and 41. Thereafter, the sheet passes downwardly over a roll 42 which guides it up an inclined ramp 44. Rolls 41 and 42 are driven and 40 is an idler roller. The roll 42 is constructed and driven so as to maintain slack and lack of tension in the film 32. An additional roll 43 is positioned at the base of the ramp 44.

The advancing and guide rollers 41 and 42 are driven by sprockets at the ends of the roller shafts and by chains 45 and 46 which in turn are driven by a shaft 47 directly connected to the drive for the film advancing belts 13 and 14.

In operation double folded plastic film 24 with interlocked profiles 23 at the edge is drawn off a supply roll 19, FIG. 2. As the folded film is drawn upwardly, it passes a centering guide 25 which positively locates the profiles of the film with respect to 360° around the vertical axis of the ascending film. The film then passes spreaders 30 and 31 to unfold it and another guide 28 again guides the interlocked profiles and insures that they will be centered. As the film 32 ascends, it passes over a grooved roll 35 which again assures centering of the film. The film then is guided and drawn over additional rollers 40, 41, 42 and 43 which are also grooved in the same manner as the roll 35 shown in FIG. 5. The film is then guided over curved shoulders 11 to be wrapped around a forming and filling tube 12 and drawn downwardly by belts 13 and 14 to have a seam 8 formed at the edge and cross-seams such as 16 form to complete the bag.

Thus, it will be seen that we have provided an improved film supply mechanism in a vertical form and fill machine which meets the objectives and advantages above set forth and which is capable of operation in machinery operating at manufacturing speeds.

We claim as our invention:

1. In a mechanism for making plastic film bags having a reclosable zipper, comprising in combination:

means for wrapping a continuous supply of film having an interlocking zipper profile between the edges over a forming tube for joining the edges in a seam;

means supporting a supply roll of film folded double with a zipper at the doubled fold and the doubled film wound over a roll so that the location of the zipper changes axially as the roll unwinds;

said folded film feeding off the supply roll in a film plane;

means unfolding the doubled film to form a single sheet as the film is fed toward the wrapping means;

a zipper locating guide positioned between the unfolding means and the supply roll positively positioning the zipper in an axial direction, said guide maintaining the zipper folded at an acute angle with said plane of the film as said film is unfolded to prevent popping open of the zipper;

and conveying means supportingly feeding the film from the guide to the wrapping means.

2. In a mechanism for making plastic film bags having a reclosable zipper constructed in accordance with claim 1:

wherein said zipper locating guide engages the edges of the zipper positioning it relative to the plane of the film.

3. In a mechanism for making plastic film bags having a reclosable zipper constructed in accordance with claim 1:

wherein said zipper locating guide cradles the zipper therein and has a zipper receiving shape to conform to the zipper.

4. In a mechanism for making plastic film bags having a reclosable zipper constructed in accordance with claim 1:

wherein the supporting means positions the supply roll for rotation about an axis at a right angle to the plane of the film as it is unfolded.

5. In a mechanism for making plastic film bags having a reclosable zipper constructed in accordance with claim 1:

wherein the zipper is centered and located equidistant between the edges of the film.

6. In a mechanism for making plastic film bags having a reclosable zipper constructed in accordance with claim 1:

wherein said conveying means are in the form of film supporting rolls.

7. In a mechanism for making plastic film bags having a reclosable zipper constructed in accordance with claim 6:

wherein said rolls have an annular recess located corresponding to the location of the zipper on the film.

8. The method of making tubular plastic film bags from film having a continuous zipper extending therealong, comprising the steps:

wrapping a continuous supply of film having an interlocking zipper profile between the edges over a forming tube for joining the edges in a seam;

supporting a supply roll of film folded double with a zipper at the doubled fold and the doubled film wound onto a roll so that the location of the zipper changes axially as the roll unwinds;

said folded double film feeding off the roll in a film plane;

unfolding the doubled film as it is fed toward the wrapping means;

and forcibly laterally locating the zipper and guiding it between the unfolding means and the supply roll positively positioning the zipper in an axial direction relative to the supply roll and after the film is guided and unfolded feeding the film from the guide to the wrapping means, said zipper located and guided by maintaining the zipper folded at an acute angle with said plane of the film as said film is unfolded to prevent popping open of the zipper.

9. The method of making tubular plastic film bags from film having a continuous zipper extending therealong in accordance with the steps of claim 8:

including engaging the zipper edges to positively locate the zipper and the film.

10. The method of making tubular plastic film bags from film having a continuous zipper extending therealong in accordance with the steps of claim 8:

including cradling the zipper with a guide shaped to fit the zipper and positioning the zipper as it is fed off of the roll.

11. The method of making tubular plastic film bags from film having a continuous zipper extending therealong in accordance with the steps of claim 8:

wherein the supply roll is unwound with its axis transverse to the plane of the unfolded film.

12. The method of making tubular plastic film bags from film having a continuous zipper extending therealong in accordance with the steps of claim 8:

wherein the film is unwound and the zipper is centered equidistant from the edges of the film.

13. The method of making tubular plastic film bags from film having a continuous zipper extending therealong in accordance with the steps of claim 8:

wherein the film is carried on rolls between the time it is unfolded and the time when it is wrapped over a forming tube.

14. In a mechanism for making plastic film bags from a reclosable zipper, comprising in combination:

a vertical hollow form, fill and seal tube;

shoulder means for wrapping a film around the tube as it moves forwardly in a downward direction;

seaming means heat sealing the edges of the film together as it is moved downwardly over the tube;

cross-seaming means for forming a cross-seal at the base of the film and located beneath the forming tube;

traveling belts for drawing the film downwardly on the tube;

rollers guiding the film to the forming shoulders;

a film unfolding means receiving doubled film and located to feed the unfolded film to the rolls;

a film roll support supporting a roll of film for rotation about an axis transverse of the plane of the film as it is supported on the rolls;

and a zipper locating guide having a zipper carrying opening shaped to hold the zipper therein and positioned to center the zipper and the film as the film is unwound off the roll, said guide maintaining the zipper folded at an acute angle with said plane of the film, as said film is unfolded to prevent popping open of the zipper.

* * * * *